United States Patent [19]

de la Merced

[11] 4,184,686

[45] Jan. 22, 1980

[54] GAME OF MENTAL ADDITION USING A DIE AND A GAME BOARD

[76] Inventor: Joselito R. de la Merced, 34861 B Aquaris, Sterling Heights, Mich. 48077

[21] Appl. No.: 860,714

[22] Filed: Dec. 15, 1977

[51] Int. Cl.[2] ..... A63F 3/00

[52] U.S. Cl. ..... 273/274

[58] Field of Search ..... 35/30; 40/621; 273/141 A, 243, 256, 268, 273, 274

[56] References Cited

U.S. PATENT DOCUMENTS

| | | | |
|---|---|---|---|
| 3,126,205 | 3/1964 | Jordan | 273/273 |
| 3,424,455 | 1/1969 | Dunson | 35/30 X |
| 3,468,540 | 9/1969 | Mulligan | 273/256 |
| 3,667,757 | 6/1972 | Holmberg | 273/274 |
| 3,917,274 | 11/1975 | Carey | 273/256 |
| 4,083,564 | 4/1978 | Matsumoto | 273/289 X |

OTHER PUBLICATIONS

"Spoof" Game, pp. 270, 271 of The Way to Play by the Diagram Group, Mar. 1976.

*Primary Examiner*—Harland S. Skogquist
*Attorney, Agent, or Firm*—Stevens, Davis, Miller & Mosher

[57] ABSTRACT

A game of mental addition using a playing board marked with betting squares and squares for placing a plurality of domes. In each dome a magnet can be attached to a number marked on the base of the dome. Space on the board is also provided for a second chance card and for a pile of money. The order in which the individual players take their turns in this game can be determined by the throwing of a die.

2 Claims, 4 Drawing Figures

GAME OF MENTAL ADDITION USING A DIE AND A GAME BOARD

I have invented a new and novel game of mental addition using a die and a game board. My game can be played by a number of players and utilizes a plurality of domes and a playing board marked with betting squares and the locations for positioning the domes. A pile of loot and a second chance card can be placed on the playing board. Play money up to approximately 50 million dollars may be used in this game along with a die for determining the order in which the players play.

My invention can be understood in view of the accompanying figures.

Figure 1:
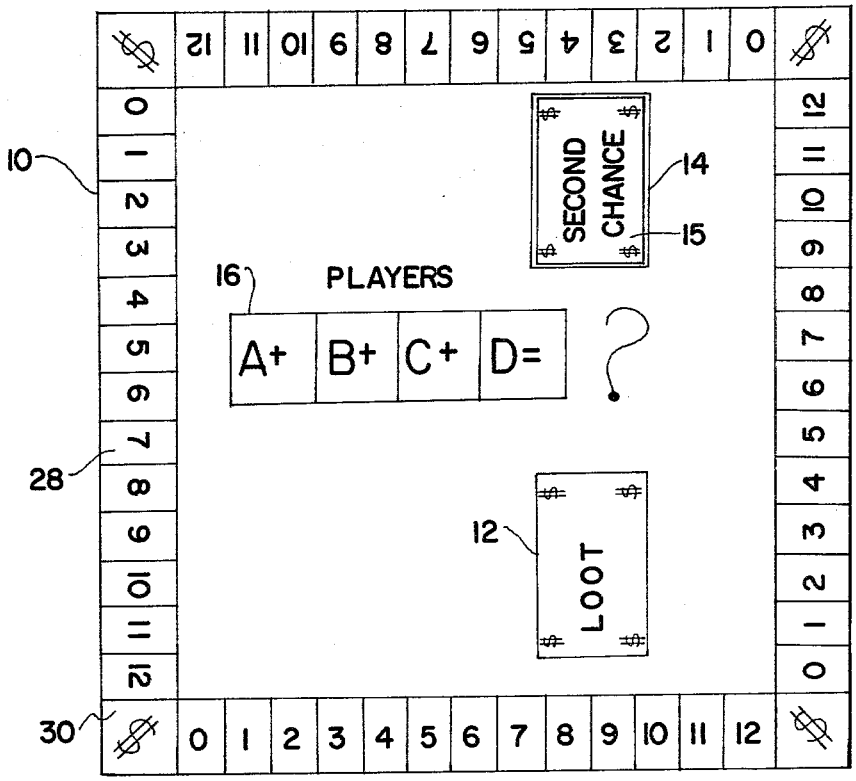
FIG. 1 is a front view of the playing board.
Figure 2:
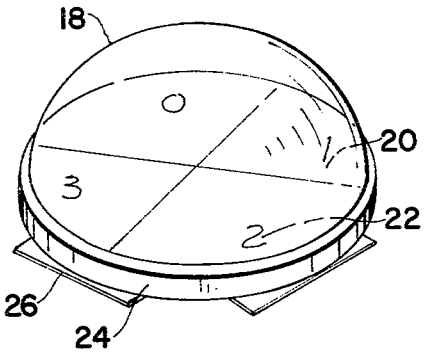
FIG. 2 is a perspective view of one of the domes.
Figure 3:
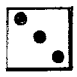
FIG. 3 is a top view of the die.
Figure 4:
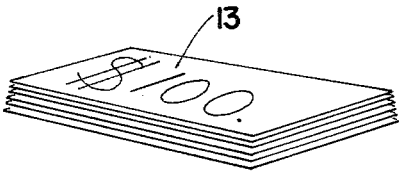
FIG. 4 is a perspective view of the play money.

With regard to FIGS. 1, 2, 3, and 4, a playing board 10 has marked on it a space 12 for a money pile and a space 14 for a special change card 15 positioned on the space in this view. Squares 16 are marked in the center of the board 10 on which domes 18 can be positioned. On the interior surface 20 of the domes 18 numbers 22 are marked. The outer rim 24 of the domes 18 can be made of a magnetic material so that magnets 26 can be positioned under the dome over the number on the base of the outer rim 24 so that the magnets 26 will not be visible when the domes 18 are positioned on the boxes 16. Betting squares 28 are marked along each edge of the playing board so that the players may place the value of their bets using the money 13 which they are allocated at the beginning of the game. Where desired the individual players may place a second guess by buying the second chance card 15 using some the play money 13. The fee for the second chance guess usually ranges from about 150 to 200% of the bet on the original guess.

My invention can be played by countless number of individuals. For example, if there are 10 players (as opposed to 4), the betting squares 28 can be expanded to 0 through 30 inclusive. This is of particular value to casino oriented players.

A PREFERRED EMBODIMENT OF RULES FOR THE GAME

The starting player is determined by a roll of the die 32. The highest roller opens the game and becomes player A; then going clockwise the turn gets to players B, C and D.

Each participating player is provided with an equal amount of play money 13 (at player's discretion), a narrow strip of magnet 26, a solid nontransparent removable dome 18 numbered inside 0, 1, 2, 3. Without showing to the opposing players, each player is requested to cover one specific number displayed in the dome with the piece of magnet given him.

Beginning with player A, he puts his dome that contains his covered selected number in the square 16 marked "A" as shown in the Game Board 10. The dome is placed with its rim 24 down to prevent the players from seeing the selected numbers. Player A is then followed by player B, C and finally D.

After all the domes have been set up in their respective squares player A calls out the amount of wager which is put up by every player and becomes the prize money.

Now, each player tries to mentally guess the actual sum of the individual numbers that have been selected and covered. (Upon completion of this mental exercise, the wagers will be placed down on the game board 10.)

Starting again with player A, he takes his wager and puts it on the number 28 which he believes will equal the total resulting from his mental addition. Players B, C and D follow same.

After every player has made his wager and guess, and before the domes are turned over; the second chance card is made available. There is only one second chance card. It is offered to player A, then B (if A does not take it) then C (if B does not take it either), then D (if neither A, nor B, nor C takes it).

However, if it is offered and then taken after paying the predetermined premium, then there is no more second chance to the subsequent players.

After offering the option of the second chance card, the domes are now turned up and the sum is checked. The player who has guessed correctly is the winner and takes all the prize money. In the event of a tie, the prize money will be divided equitably. However, if there is no winner, the prize money will be transferred to the "Loot" box and is added to the next game's prize money.

In starting the next game, the players will move up one notch thus making player A now player D, player B now player A, player C now player B and player D now player C.

Having described a preferred embodiment of my invention, it is understood that various changes can be made departing from the spirit of my invention, and, I desire to cover by the appended claims all such modifications as fall within the true spirit and scope of my invention.

What I claim and seek to secure by Letters Patent is:

1. Apparatus for playing a board type game, comprising, a playing board, a plurality of means for indicating a number, a card denominated a second chance card, and play money, wherein the surface of said board has outlined on it a plurality of playing spaces, each space being for the placement of one of said number indicating means, and wherein the surface of said board has outlined on it a playing space for the placement of said second chance card, and wherein the surface of said board has outlined on it a playing space for containing an amount of said paper money, and wherein the surface of said board has outlined on it a continuous strip of playing spaces along each side of said board for the placement of an amount of play money, each space being marked with a different number, said number indicating a possible sum of the numbers indicated by each of said number indicating means.

2. Apparatus as in claim 6, wherein said means for indicating a number comprises a playing piece having upper and lower surfaces, said upper surface having spaces outlined on it, each space being marked with a number, said playing piece having a magnetic rim by which it contacts said playing board, and a strip magnet adapted to be positioned on said lower surface by said magnetic rim at a location corresponding to one of the spaces on said upper surface.

* * * * *